US005673530A

United States Patent [19]

Bailey, II

[11] Patent Number: 5,673,530

[45] Date of Patent: Oct. 7, 1997

[54] MODULAR BLOCK RETAINING WALL SYSTEM

[75] Inventor: Joseph S. Bailey, II, Roswell, Ga.

[73] Assignee: The Tensar Corporation, Atlanta, Ga.

[21] Appl. No.: 591,266

[22] Filed: Jan. 25, 1996

[51] Int. Cl.[6] ..... E04B 5/04

[52] U.S. Cl. ..... 52/606; 405/284; 405/286; 52/562

[58] Field of Search ..... 52/606, 604, 607, 52/611, 562, 564, 565, 585.1, 295, 426; 405/284, 286

[56] References Cited

U.S. PATENT DOCUMENTS

| | | |
|---|---|---|
| Re. 34,314 | 7/1993 | Forsberg . |
| D. 250,484 | 12/1978 | Muse . |
| D. 296,007 | 5/1988 | Forsberg . |
| D. 296,365 | 6/1988 | Forsberg . |
| D. 297,464 | 8/1988 | Forsberg . |
| D. 297,574 | 9/1988 | Forsberg . |
| D. 297,767 | 9/1988 | Forsberg . |
| D. 298,463 | 11/1988 | Forsberg . |
| D. 346,031 | 4/1994 | Risi et al. . |
| D. 350,611 | 9/1994 | Scales . |
| 991,722 | 5/1911 | Hourd . |
| 1,751,272 | 7/1930 | Forman . |
| 1,992,785 | 9/1935 | Steuer . |
| 2,201,110 | 6/1940 | Makram . |
| 2,552,712 | 5/1951 | Ellis ..... 52/606 X |
| 3,461,631 | 8/1969 | Brugnola . |
| 3,609,926 | 10/1971 | Muse . |
| 3,686,873 | 8/1972 | Vidal . |
| 4,031,678 | 6/1977 | Schuring . |
| 4,068,482 | 1/1978 | Hilfiker . |
| 4,123,881 | 11/1978 | Muse . |
| 4,186,540 | 2/1980 | Mullins . |
| 4,324,508 | 4/1982 | Hilfiker et al. . |
| 4,374,798 | 2/1983 | Mercer . |
| 4,470,728 | 9/1984 | Broadbent . |
| 4,616,959 | 10/1986 | Hilfiker . |

(List continued on next page.)

FOREIGN PATENT DOCUMENTS

| | | |
|---|---|---|
| 2075580 | 8/1992 | Canada . |
| WO85/03535 | 8/1985 | WIPO . |
| WO94/13890 | 6/1994 | WIPO . |

OTHER PUBLICATIONS

"Concrete Geowall Package", Tensar, 10 pages.

"Minislope System", Permacon, pp. 1593–1594.

Newcastle "Retaining Wall Systems"—Technical Data, 1 page.

Newcastle, "Retaining Wall Systems", Elements of the System, 3 pages.

*Primary Examiner*—Carl D. Friedman
*Assistant Examiner*—Creighton Smith
*Attorney, Agent, or Firm*—Jacobson, Price, Holman & Stern, PLLC

[57] ABSTRACT

A modular wall block is formed with a T-shaped through-opening defining arm sections projecting from a stem portion in each surface of the block. One arm section in the upper surface of each block is dimensioned to frictionally receive fingers of a rake-like connection device which may thereby secure an end portion of sheet of reinforcing material such as a geogrid or the like, to the block. The connection device includes enlarged tabs projecting away from the fingers to engage in a different width arm section defined in the lower surface of superimposed wall blocks for positioning the front faces of the blocks in the retaining wall relative to each other in either a vertically aligned or vertically set back relationship depending upon the direction of extension of the tabs. Stair-step sections of interconnected blocks may be interleaved to form a retaining wall. Additional connection devices may be inverted to further integrate juxtaposed stair-step sections. Likewise, the sheet of reinforcing material may span a plurality of blocks in each course to secure the stair-step sections to each other. The blocks may be used as corner blocks provided with similar aesthetic patterns on a front and a side surface for forming corner portions of sections of a retaining wall extending at right angles to each other.

20 Claims, 9 Drawing Sheets

U.S. PATENT DOCUMENTS 4,661,023 4/1987 Hilfiker .
4,802,320 2/1989 Forsberg .
4,825,619 5/1989 Forsberg .
4,914,876 4/1990 Forsberg .
5,044,834 9/1991 Janopaul, Jr. .
5,064,313 11/1991 Risi et al. .
5,066,169 11/1991 Gavin et al. .
5,122,015 6/1992 Shen .
5,145,288 9/1992 Borcherdt .
5,154,542 10/1992 Klenert .
5,214,898 6/1993 Beretta .
5,248,226 9/1993 Risi et al. .
5,257,880 11/1993 Janopaul, Jr. .
5,417,523 5/1995 Scales .

MODULAR BLOCK RETAINING WALL SYSTEM

FIELD OF THE INVENTION

This invention relates to a modular wall block system, and, particularly, to a modular wall block system incorporating a connector device to integrate superimposed courses of wall blocks into a retaining wall or the like. Extended lengths of grid-like sheets of material may be positioned between selected courses of such wall blocks to form a reinforced retaining wall or the like. The wall blocks of this invention are designed for ease in positioning and locating individual blocks relative to each other during construction of a retaining walls and are particularly adapted to form a corner of a retaining wall having sections which are perpendicular to each other.

BACKGROUND OF THE INVENTION

Retaining walls are commonly used for architectural and site development applications. In civil engineering structures, the wall facing must withstand very high pressures exerted by backfill soils. Reinforcement and stabilization of the soil backfill is commonly provided by grid-like sheet materials that are placed in layers in the soil fill behind the wall face to interlock with the wall fill soil and create a stable reinforced soil mass. Connection of the reinforcing material to the elements forming the wall holds the wall elements in place and resists soil backfill pressures.

A preferred form of grid-like tie-back sheet material used to reinforce the soil behind a retaining wall structure, known as an integral geogrid, is commercially available from The Tensar Corporation of Atlanta, Ga. ("Tensar") and is made by the process disclosed in U.S. Pat. No. 4,374,798 ("the '798 patent"), the subject matter of which is incorporated herein in its entirety by reference. However, other forms of tie-back sheet materials have also been used as reinforcing means in the construction of retaining walls, and the instant inventive concepts are equally applicable with the use of such materials. Regardless of the particular tie-back, difficulties are encountered in providing a secure interconnection between the reinforcing means and the wall elements, especially in areas of high earthquake (seismic) activity.

In a brochure entitled "Concrete Geowall Package", published by Tensar in 1986, various retaining wall structures are shown using full height cast concrete panels. In one such retaining wall structure, short strips or tabs of geogrid material, such as shown in the '798 patent, are embedded in the cast wall panels. On site, longer strips of geogrid are used to reinforce the wall fill, creating a stable soil mass. To connect the geogrid tabs to the reinforcing geogrid, the strands of one portion of geogrid are bent to form loops, the loops are inserted between the strands of the other portion of geogrid so that the loops project out of the second portion of geogrid, and a rod is passed through the loops on the opposite side of the second portion to prevent the loops being pulled back through, thereby forming a tight interconnection between the two portions of geogrid, sometimes referred to as a "Bodkin" joint.

Use of full height pre-cast concrete wall panels for wall-facing elements in a retaining wall requires, during construction, that the panels be placed using a crane because they are very large, perhaps 8 by 12 feet or even larger and, as a result, are quite heavy such that they cannot be readily man-handled. To avoid such problems in the use of pre-cast wall panels other types of retaining wall structures have been developed. For example, retaining walls have been formed from modular wall blocks which are typically relatively small as compared to cast wall panels. The assembly of such modular wall blocks usually does not require heavy equipment. Such modular wall blocks can be handled by a single person and are used to form retaining wall structures by arranging a plurality of blocks in courses superimposed on each other, much like laying of brick or the like. Each block includes a body with a front face which forms the exterior surface of the retaining wall.

Modular wall blocks are formed of concrete, commonly mixed in a batching plant with only enough water to hydrate the cement and hold the unit together. Such blocks may be commercially made by a high-speed process which provides a mold box having only sides, without a top or bottom, positioned on top of a steel pallet which contacts the mold box to create a temporary bottom plate. A concrete distributor box brings concrete from the batcher and places the concrete in the mold box and includes a blade which levels the concrete across the open top of the mold box. A stripper/compactor is lowered into the open, upper end of the box to imprint the block with a desired pattern and to compress the concrete under high pressure. The steel pallet located at the bottom of the mold box resists this pressure.

A vibrator then vibrates the mold box to aid in concrete consolidation. After approximately ½ to four seconds, the steel pallet is moved away from the bottom of the mold box which has been positioned above a conveyor belt. The stripper/compactor continues to press on the formed concrete to push the modular wall block out of the mold box onto the conveyor belt. This process takes about seven to nine seconds to manufacture a single wall block. The formed wall block is cured for approximately one day to produce the final product.

With this high-speed method of construction, it is not practical to embed short strips or tabs of grid-like material in the blocks in the manner of the pre-cast wall panels shown in the Tensar brochure to enable interconnection with a grid-like reinforcing sheet material directly or by a Bodkin-type connection or the like. Therefore, other means for securing the reinforcing grid to selected modular blocks used to construct a retaining wall have had to be devised.

In an attempt to provide alternative means for securing the reinforcing grid to selected modular block, a modular wall block system as disclosed in copending U.S. application Ser. No. 08/254,710, filed Jun. 6, 1994,now U.S. Pat. No. 5,540,525, commonly associated with the instant application and incorporated herein in its entirety by reference, has been developed. The upper surface of the wall blocks in the system of the '710 application is recessed to accommodate the end portions of a sheet of grid-like reinforcing material and a groove is formed across the recessed portion, parallel to, and set back from, the front face. A plurality of spaced teeth or fingers projecting from a common spine or cross bar of a comb-like grid connection device are passed downwardly through the apertures on the end portions of the grid sheet and frictionally engaged in the groove to positively secure the grid to the block without reliance on the weight of a superimposed course of blocks. Thus, the grid-like sheet of material is securely retained by the grid connection device even in the event of a vertical acceleration of the wall blocks which may occur during an earthquake or the like.

The grid connection device may be formed of steel, aluminum, fiberglass, a plastic reinforced with fiberglass or, preferably, a high strength polymer. The fingers may be provided with serrations to enhance the frictional engagement with the sidewalls of the groove in the wall block and lock the connection device in place. Thus, load is transferred from the grid-like sheet of material through the fingers and spine of the connection device to the modular wall block.

An improved modular wall block system is disclosed in commonly assigned, copending U.S. application Ser. No. 08/370,324, filed Jan. 10, 1995, also incorporated herein in its entirety by reference. In addition to the groove in the upper surface of the wall blocks of the '324 application, a slot is formed in the lower surface, parallel to, and set back from, the front face. The slot in the lower surface is wider than the groove in the upper surface. In this system the comb-like grid connection device is also provided with a plurality of spaced tabs which extend upwardly from the spine to slidingly engage in the slots of superimposed wall blocks when the retaining wall is being built. The tabs are wider than the fingers in a direction transverse to the spine. Thus, if one edge of the fingers are aligned with one edge of the tabs, the other edge of the tabs extend beyond the other edge of the fingers. As described in detail in the '324 application, by properly dimensioning the tabs vis-a-vis the set back of the slot, the front faces of superimposed courses of wall blocks in a retaining wall may selectively be vertically aligned or stepped back by turning the grid connection device 180° about a vertical axis in use.

SUMMARY OF THE INVENTION

It is, therefore, a primary object of this invention to provide a simple and inexpensive modular wall block system formed of a plurality of wall blocks and including a connection means for selectively vertically aligning or setting back the front faces of superimposed courses of wall blocks, where the connection means may also positively secure extended lengths of grid-like reinforcing sheet material to the wall blocks, if desired.

A further object of this invention is the provision of such a modular wall block system where the wall blocks each have a through-opening extending between their upper and lower surfaces to define, respectively a groove for reception of fingers of a connection device in at least the upper surfaces and a slot for reception of the tabs of the connection device in at least the lower surfaces.

Still another object of the invention is the provision of modular wall blocks having a T-shaped through-opening wherein the cross-bar of the T is formed of two arms of unequal width measured in a direction from the front to the rear of the wall blocks. The arm of less width is designed to fractionally receive the fingers of a connection device in at least an upper surface of a lower tier wall block. The wider arm slidingly receives the locating tabs of a connection device in at least the lower surface of an upper tier or superimposed wall block. For ease of manufacture, each block may be initially formed with a slight taper with the side walls diverging upwardly so the formed concrete wall block may be easily pressed downwardly by the stripper/compactor to free the same from a tapered core or molding element fixed within the mold box during manufacture of the block.

Thus, according to a preferred embodiment of the instant inventive concepts, a wall block according to this invention, useful in forming the corner of a retaining wall having perpendicularly extending sections, includes a through-opening spaced inwardly from the front face, rear face and side walls of the block to receive short sections of connection devices in arms formed by the through-opening.

As indicated, a preferred grid-like sheet reinforcing material may be made according to the techniques disclosed in the above-identified '798 patent. Preferably, uniaxially-oriented geogrid materials as disclosed in the '798 patent are used, although biaxial geogrids or grid materials that have been made by different techniques such as woven, knitted or netted grid materials formed of various polymers including the polyolefins, polyamides, polyesters and the like or fiberglass, may be used. In fact, any grid-like sheet material, including steel (welded wire) grids, with interstitial spaces capable of being secured to selected modular wall blocks with the connection device of the instant invention in the manner disclosed herein are suitable. In addition, it is possible that felt-like fabrics, including woven or non-woven, solid or perforated geofabrics, geonets, or even composite materials including some form of geofabric and/or geogrid laminates may be used as the reinforcing material according to this invention. All of such materials are sometimes referred to herein and in the appended claims as "grid-like sheets of material", whether they are formed with apertures, or not.

With the preferred reinforcing material of the '798 patent, a high strength geogrid is formed by stretching an apertured plastic sheet material. Utilizing the uniaxial techniques, a multiplicity of molecularly-oriented elongated strands and transversely extending bars which are substantially unoriented or less-oriented than the strands, are formed. The strands and bars together define a multiplicity of grid openings. With biaxial stretching, the bars are also formed into oriented strands. In either event, or when using other apertured grid-like sheets of material, the fingers of the grid connection device are spaced apart equal to a spacing between strands of the grid-like sheet of material, but may also be spaced apart several times the spacing between strands of the grid-like sheet of material such that some, but not necessarily every, grid opening receives a finger.

If the "grid-like" reinforcing sheets are not initially formed with apertures such as in a geofabric or the like, the fingers of the connection device may be used to actually puncture or perforate the sheet in use to secure the same to the modular wall blocks of the invention. In fact, it will be readily recognized that the sheet material need not even be perforated to produce a secure attachment to the modular wall blocks; the groove in the block and the fingers of the connection device can be dimensioned to wedge a section of the reinforcing sheet in the groove when the fingers of the connection device are driven into the groove.

At a construction site, a plurality of modular wall blocks are commonly stacked in laterally staggered, vertically superimposed, courses. When constructing a retaining wall of limited height, generally less than six feet, and usually straight, such as may be formed in a residential setting, the fingers of the connection device may be secured within the one (narrower) arm of the T-shaped through-opening on the upper surface of each block. The other (wider) arm defined by the T-shaped other end of the through-opening in the lower surface of superimposed wall blocks may cooperate with the upwardly projecting tabs on the connection device. The locating tabs may selectively form a retaining wall where the front faces of the stacked courses of wall blocks are vertically aligned or vertically set-back depending upon the orientation of the connection device. Such a construction would produce juxtaposed sections of the retaining wall comprising superimposed, laterally staggered, wall blocks interconnected in stair-step fashion, with the blocks of such sections resting on each other to integrate the sections into a continuous retaining wall by the effect of gravity.

Alternatively, additional connection devices may be used to fixedly secure the stair-step sections to each other by driving the fingers of a connection device into the narrower arm of the T-shaped through-opening located in the lower surface of superimposed wall blocks. The tabs of such additional connection devices, now downwardly projecting, would seat in the wider arm of the upper surface of a successively lower course of wall blocks in a juxtaposed stair-step section. Each wall block would thereby be engaged with at least two other wall blocks when successive courses of wall blocks are laid to build a retaining wall.

For walls of greater height, or where desired, the fingers of the connection device may be secured in selected blocks so as to capture the end portions of elongated lengths of grid-like sheets of reinforcing material, either by passing through preformed apertures in such reinforcing material, forming perforations in situ, or merely wedging the end portions in the block openings, the remainder of the reinforcing sheet being stretched out and interlocked with the fill soil or aggregate behind the retaining wall. In this manner, the sheets of grid-like sheet of material reinforce the fill so as to create a stable mass behind the retaining wall. Moreover, if the sheets of grid-like material span several adjacent wall blocks in a course of wall blocks, the adjacent stair-step sections would be laterally inter-connected by the grid-like sheets, without the need for additional connection devices as described in the alternative embodiment described above.

Other forms of modular wall blocks which may be used as corner blocks are disclosed in commonly assigned U.S. application Ser. No. 08/591,319, filed simultaneously herewith in the name of Joseph S. Bailey, II, et al. the disclosure of which is incorporated herein in its entirety by reference.

The modular wall block according to the present invention may include substantially flat upper and lower surfaces with a single T-shaped through-opening defining a centrally located stem with arms of different widths forming the cross-bar of the T and the grooves or slots of the block. The wall block is preferably about 7⅝ inches high, 18 inches wide and 8 inches deep. These blocks may be used as corner blocks in combination with other types of wall blocks or they may be used to form retaining walls, generally of limited height, by themselves, with or without grid-like reinforcing material.

The modular wall blocks of this invention are preferably molded as double blocks, and then split transversely to form a roughened or jagged exterior facing for aesthetic reasons. To form a jagged exterior face at a corner surface, a side portion of the block can be broken away in the same way.

The above and other objects of the invention, as well as many of the attendant advantages thereof, will become more readily apparent when reference is made to the following detailed description, taken in conjunction with the accompanying drawings.

DETAILED DESCRIPTION OF THE PREFERRED EMBODIMENTS

Figure 1:
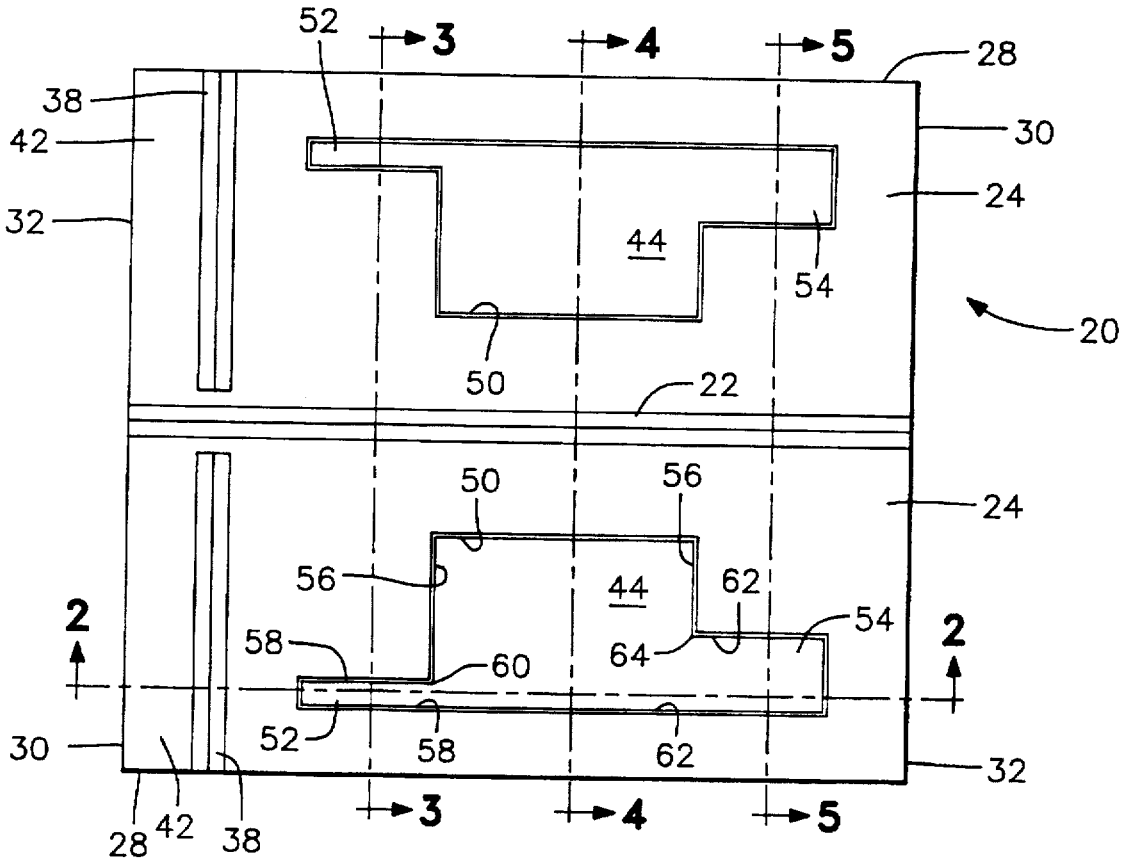
FIG. 1 is a plan view of a molded double wall block which, when split, forms two separate wall blocks with jaggered front faces, and which includes additional splitting grooves to form a jagged side surface when the block is used as a corner block.
Figure 2:
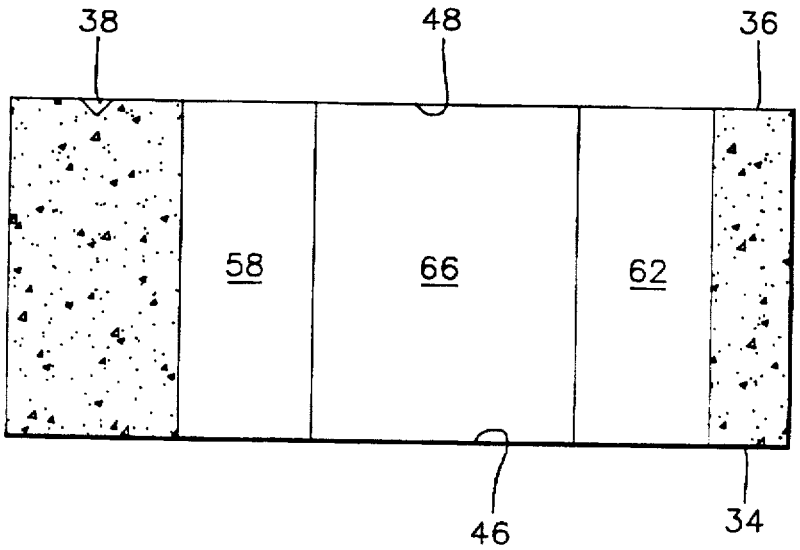
FIG. 2 is a sectional view taken along line 2—2 of FIG. 1.
Figure 3:
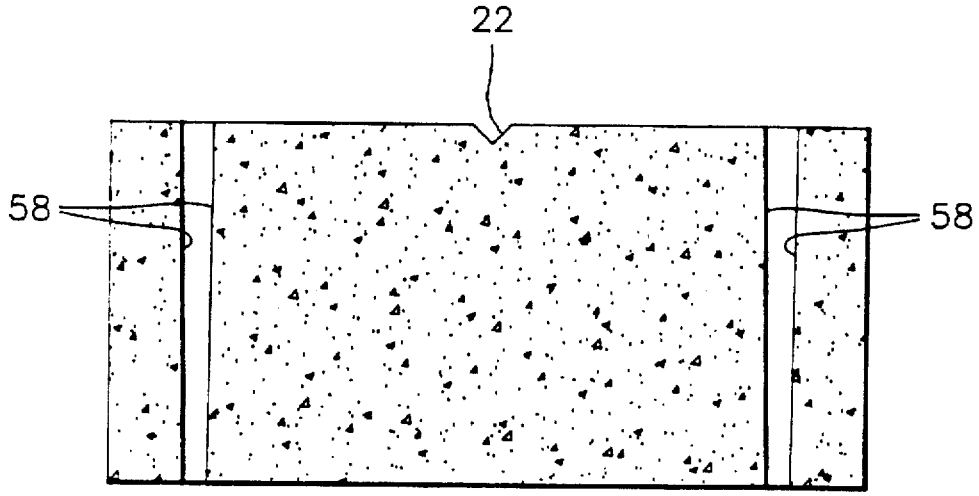
FIG. 3 is a cross-sectional view taken along line 3—3 of FIG. 1.
Figure 4:
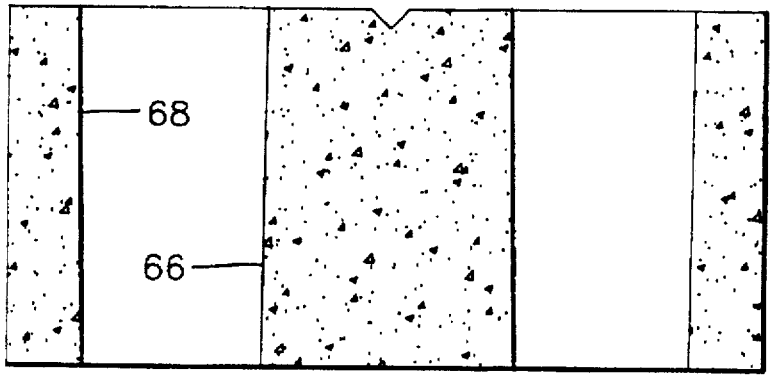
FIG. 4 is a cross-sectional view taken along line 4—4 of FIG. 1.
Figure 5:
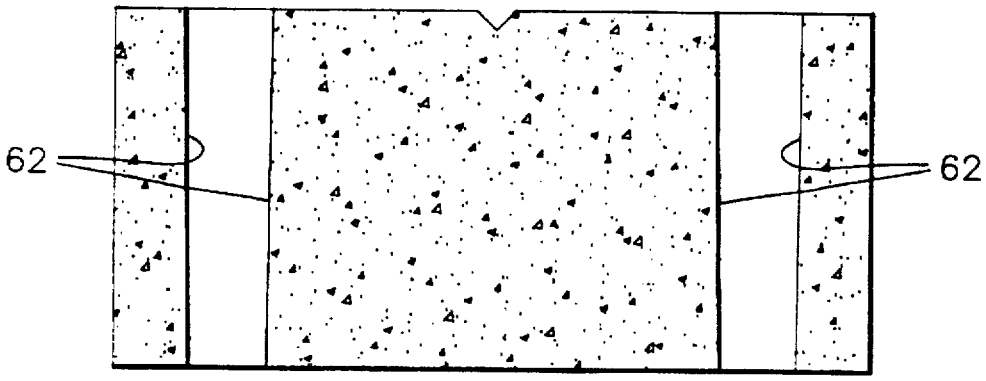
FIG. 5 is a cross-sectional view taken along line 5—5 of FIG. 1.

In describing preferred embodiments of the invention as illustrated in the drawings, specific terminology will be used for the sake of clarity. However, the invention is not intended to be limited to the specific terms so selected, and it is to be understood that each specific term includes all technical equivalents which operate in a similar manner to accomplish a similar purpose. Further, while preferred dimensions are set forth to describe the best mode currently known for the modular wall block system of this invention, these dimensions are illustrative and not limiting on the instant inventive concepts.

While a retaining wall formed by assembling a multiplicity of modular wall blocks according to this invention is shown in some of the drawings as providing a vertical exterior facing surface, as is well known, succeeding courses of modular wall blocks are commonly shifted slightly rearwardly for stability and appearance. As explained in more detail below, the instant inventive concepts readily enable the construction of a retaining wall having either design.

While the preferred embodiment hereof is shown and described with reference to a uniaxially-oriented polymer geogrid such as is disclosed in the '798 patent, alternative grid-like tieback reinforcing sheet materials may be substituted therefor, including grid-like sheet materials manufactured using weaving, knitting or netting techniques, steel (welded wire) grid, geonets, geofabrics, solid sheet materials or composites may be used as well.

With reference now to the drawings in general, and FIGS. 1 through 5 in particular, a preferred embodiment of a modular wall block as cast according to this invention is shown. It is common practice to initially mold double blocks designated generally by the reference numeral 20.

Since the dimensions of the T-shaped openings formed in each surface of the individual wall blocks 24 resulting from splitting a double wall block 20, are only mominally different as a result of the slight taper of the through-opening which facilitates manufacturing the blocks, the blocks may be used with either side up in constructing a retaining wall therefrom.

Double block 20 is molded with a peripheral groove 22, which may be impacted with a chisel or pointed device (not shown) to split the double block 20 apart to form the pair of modular wall blocks 24. Each of the thus formed wall blocks will have an aesthetic jagged front face 26.

Each wall block 24, in addition to the front face 26, includes a rear face 28, parallel to the front face 26, parallel side walls 30, 32, a lower surface 34 (which could be the upper surface of the wall block in use), and an upper surface 36. The lower and upper surfaces 34 and 36, also extend parallel to each other.

If the wall blocks 24 are to be used as corner blocks each block is provided with a further groove 38 extending from the rear face 28 toward the front face 26 to form a jagged side face 40 for aesthetic continuity of the retaining wall surface as will discussed below with particular reference to FIG. 14. If the blocks are to be used in non-corner positions, either the end section 42 is not removed, the wall blocks are molded without this section, or special considerations are made when assembling a wall of the blocks to provide for proper positioning of mechanical connections between superimposed courses. End sections can be provided on either side of the center line of the wall block 24 for forming opposite corners of a retaining wall, but this is not generally necessary since the wall blocks 24 may simply be inverted to present the jagged face 40 at either side.

A T-shaped through-opening 44 extends through each block 24 between surfaces 34 and 36. Through-opening 44 terminates in T-shaped apertures 46, 48 in the surfaces 34, 36, respectively. The T-shaped aperture in each surface includes a stem section 50 and a pair of arm sections 52, 54 defining the cross-bar of the T.

The width of the arm sections 52 and 54 is measured in a direction from the front face 26 towards the rear face 28 of the blocks 24. The arm sections 52 are of a width (from front to rear) of approximately 0.52 inches at the surface 34 and 0.78 inches at surface 36. The arm sections 54 are a width (from front to rear) of approximately 1.625 inches at surface 34 and 1.825 inches at surface 36. The differences in widths for each of the arm sections 52,54 at the surfaces 34 and 36 is attributable to a slight taper of the mold elements or core used to form the T-shaped through-opening 44 so that the molded blocks are easily pushed off of the mold elements during manufacture. The stem sections 50 are about 5.72 inches long (from side to side) and 3.8 inches wide at surface 34 and 5.92 inches long and 4.0 inches wide at surface 36.

In the lower and upper surfaces 34 and 36, the arm sections 52 define a groove which is parallel to, and set back from, the front face 26. Likewise, in the lower and upper surfaces 34 and 36, the arm sections 54, define a slot which is parallel to, and set back from, the front face 26. The groove and slot in the wall block interact with the fingers and tabs of a connecting device to interconnect superimposed walls blocks in a retaining wall, secure a geogrid or the like thereto, if desired, and selectively position the front faces of stacked courses of wall blocks in a vertical or stepped back orientation. Additionally, since the side surfaces of the wall blocks 24 are perpendicular to the front, and are continuous, i.e., the grooves and slots do not extend to the side surfaces, they may be provided with a jagged surface like the front face and can be effectively used to form corners in a retaining wall having portions extending at right angles to each other with aesthetically compatible facings.

Referring now in more detail to the blocks 24, the stem section 50 of the T-shaped through-opening 44 includes two parallel side walls 56 interconnected with the front wall of parallel front and rear walls 58 of the arm sections 52 of the groove at right angle intersections 60 and the front wall of parallel front and rear walls 62 of the arm sections 54 of the slot at right angle intersections 64.

The stem section 50 includes front wall 66 and rear wall 68. The stem section of the through-opening 44 lightens the block and facilitates lifting and placing blocks in constructing a retaining wall.

Figure 6:
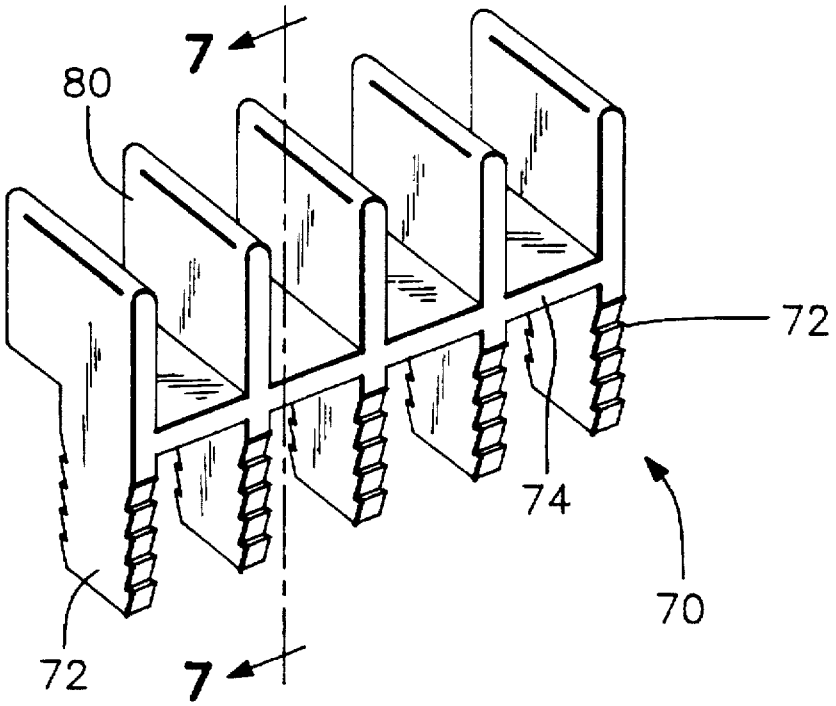
FIG. 6 is a perspective view of a connection device for use in connection with the wall blocks of the present invention so as to vertically align or offset the front faces of superimposed courses of wall blocks.
Figure 7:
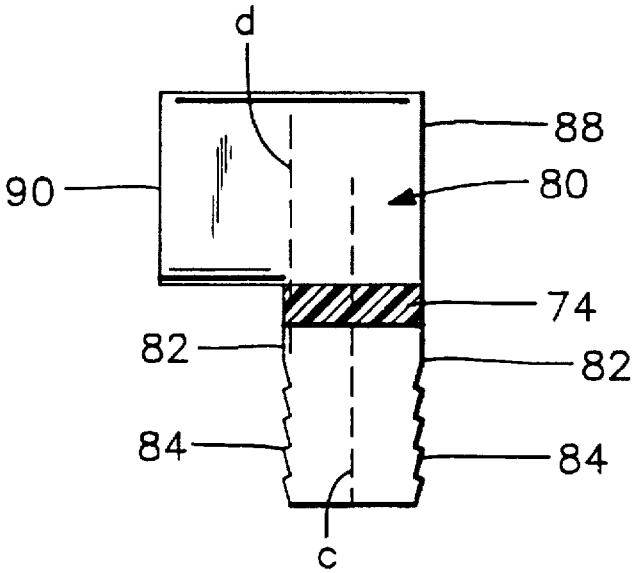
FIG. 7 is a cross-sectional view taken along line 7—7 of FIG. 6.

Details of one form of a preferred connection device are shown at 70 in FIGS. 6 and 7. The connection device 70 includes a plurality of fingers 72 extending substantially parallel to each other and interconnected at one end by a spine 74. For use with the wall block of this invention, the length of the spine 74 is preferably equal to, or less than, the length of the arm 52, which in the preferred embodiment is about 3 inches. The fingers 72 of the grid connection device 70 may be spaced apart by a distance equal to, or a multiple of, the spacing between the openings 76 formed by bars 94 and strands 96 of a uniaxially oriented geogrid 92 as seen particularly in FIGS. 12 and 13. Obviously, other spacing may be appropriate if different grid-like sheets of reinforcing materials are used.

Figure 12:
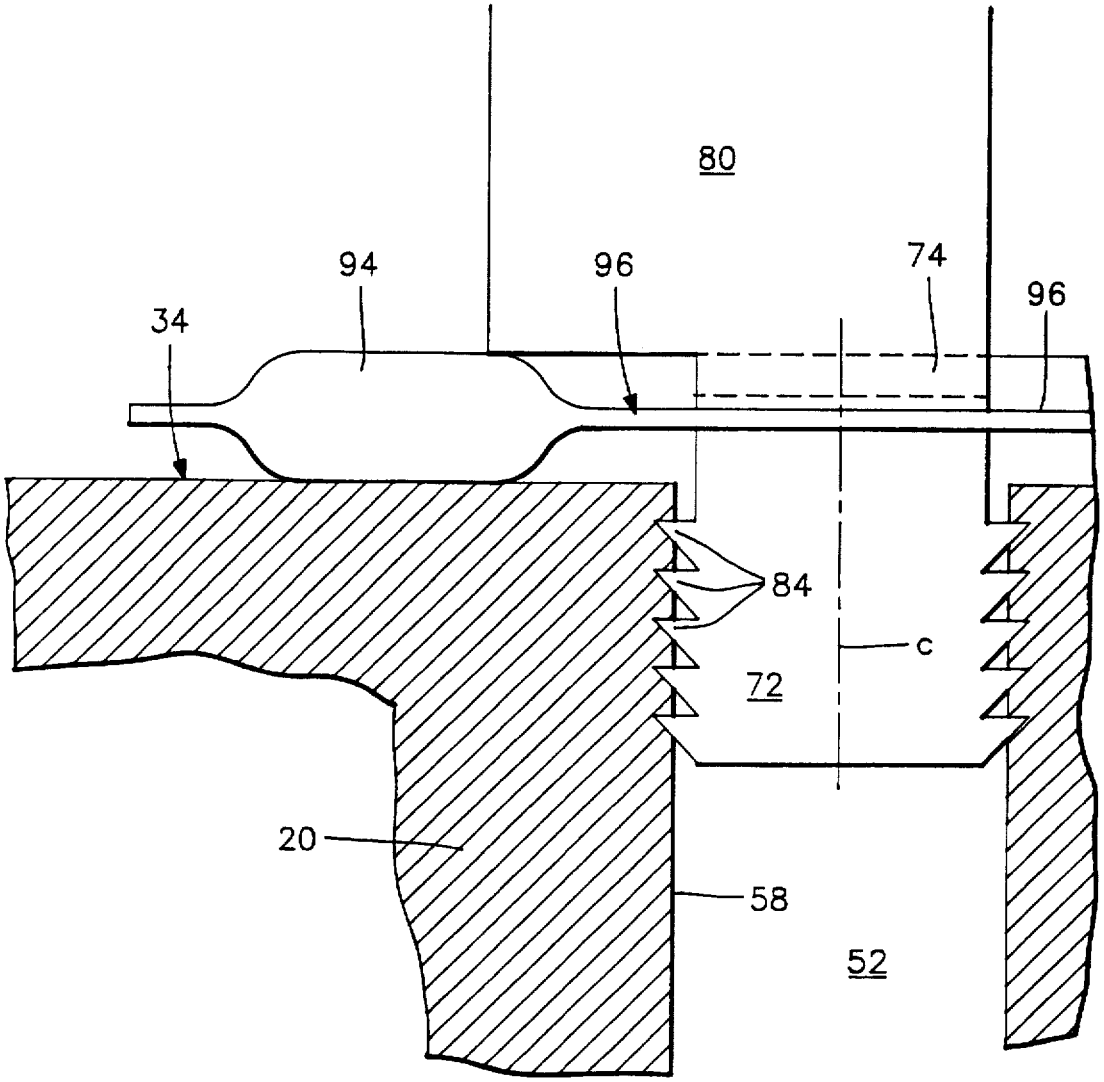
FIG. 12 is an enlarged fragmentary sectional view of end portions of a uniaxially oriented geogrid secured to the top surface of a wall block made in accordance with this invention.

As shown in detail in FIG. 7, the fingers 72 preferably include lateral sidewalls 82, which include, proceeding downwardly from spine 74, a plurality of spike projections 84. Spike projections 84 extend approximately 1/16 inch beyond the sidewalls 82 of the fingers 72. Each spike projection 84 has an overall height of approximately 3/16 inch. In FIG. 12, the spike projections 84 are schematically shown engaging a sidewall 58 of arm section 52.

Due to the resilient nature of the material of the connection device 70, the spike projections 84 are driven downwardly along the sidewalls 58 of the arm section 52 for frictional engagement with the sidewalls 58. By the angle of inclination of the spike projections 84, it is possible to drive the fingers 72 downwardly into the groove 42 whereas considerable force would be required to extricate the connection device 70 from the groove 42.

If the reinforcing sheet is imperforate, the fingers 72 may be sharpened (not shown) to puncture the sheet in use. Alternatively, the sheet may be wedged into the groove by the fingers (also not shown) in an obvious manner.

Spaced across the connection device 70 on a side of the spine 74 opposite to that of the downwardly projecting fingers 72 are upwardly extending locating tabs 80. A tab 80 preferably extends above the spine 74 in alignment with a majority of the downwardly projecting fingers 72, although the tabs 80 need not be aligned with the fingers 72 and for some applications only a limited number of tabs may be desirable. Further, the tabs 80 may form a single bar (not shown) connected to an upper end of the fingers 72, thereby avoiding the need for a spine.

Preferably, an overall width of the tab 80 is 1.375 inches. In combination, the height of the connection device from the top of the tab 80 to the bottom of the finger 72 is approximately 2.125 inches.

The tabs 80, in the preferred embodiment, include one lateral edge 88 in alignment with one lateral edge of the fingers 72. It is also possible for the lateral edges 88 of the tabs 80 to be offset inwardly or outwardly from the lateral edges of the fingers 72. However, the opposite lateral edges 90 of the tabs 80 projects beyond the other lateral edges of the fingers 72 by a distance approximating the difference in width between the arm section 52 and the arm section 54. This relationship may be defined by central axis "c" of the fingers 72 being laterally offset from central axis "d" of the tabs 80 by about ½ that distance.

Figure 8:
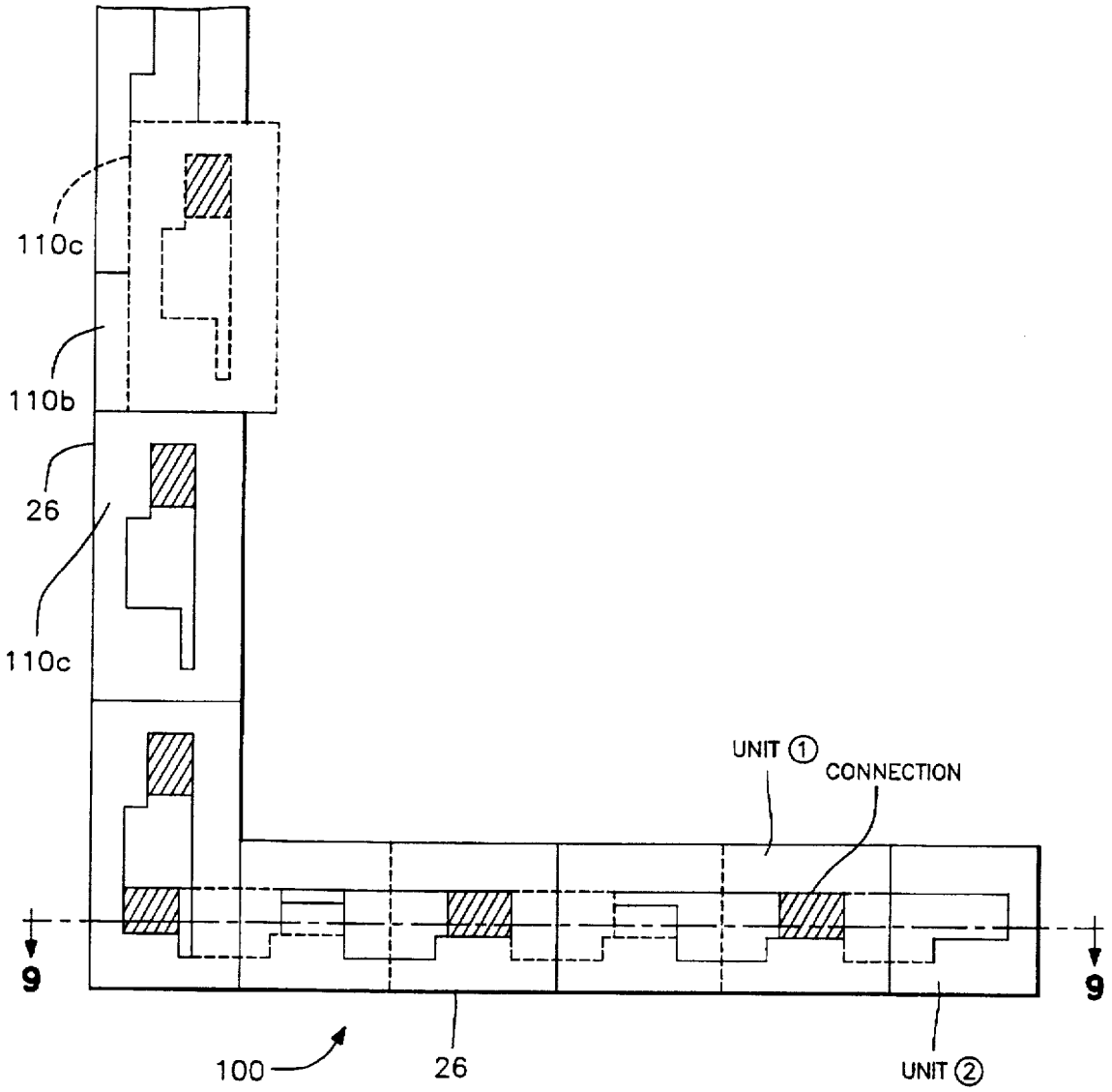
FIG. 8 is a schematic plan view of one embodiment of a retaining wall formed entirely of modular wall blocks according to this invention, the retaining wall including perpendicularly extending portions defining a right-angled corner, with laterally off-set superimposed blocks being interconnected by short comb-like connector devices to form adjacent stair-step sections which rest on each other by gravity to produce a continuous wall and with one of the blocks shown in phantom as offset rearwardly from the other blocks to step back the front faces of superimposed courses of blocks, if desired.
Figure 9:
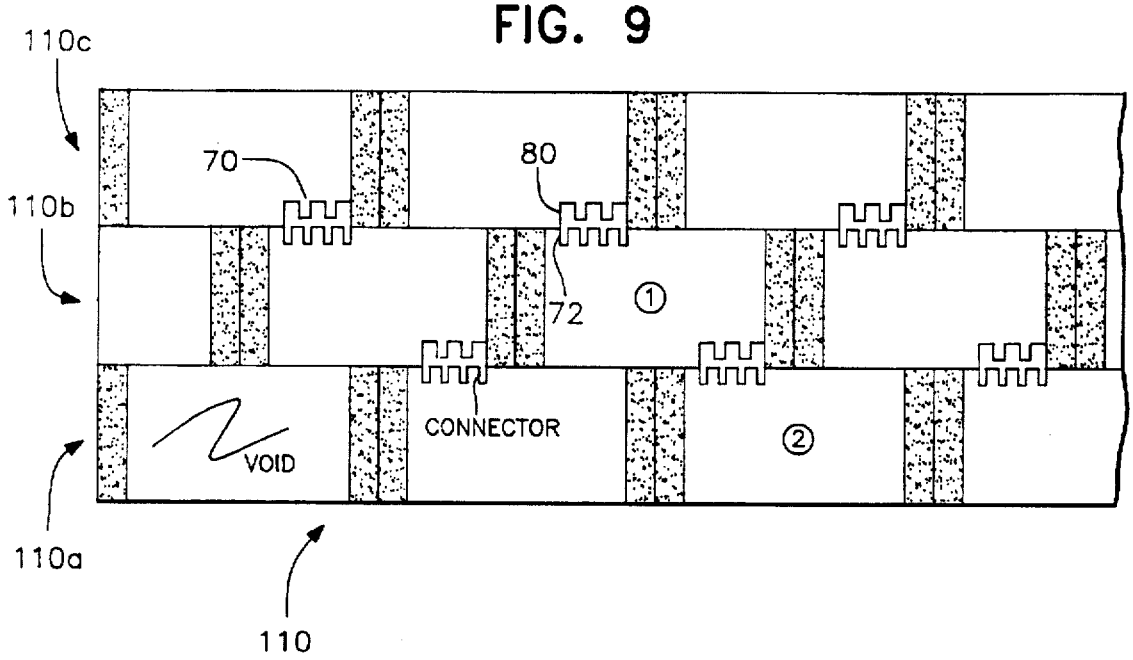
FIG. 9 is a cross-sectional view taken along line 9—9 of FIG. 8.

In constructing a retaining wall 110, such as shown in FIGS. 8 and 9, a plurality of modular wall blocks according to this invention are positioned side by side in the usual manner to form a first course 110*a*. The fingers 72 of a connecting device 70 are secured in the arm section 52 in the upper surfaces 34 of each wall block with the offset portion of the tab 80 facing forwardly if the front faces of the wall blocks in the retaining wall are to be vertically aligned. Alternatively, if the front faces are to be stepped rearwardly, the fingers 72 of the connection devices 70 are engaged in the arm section 52 with the offset portions of the tabs 80 facing rearwardly.

Thus, the direction of the offset portion or extension of the tabs 80 of the connection devices 70 selectively aligns the front faces 26 of successive courses 110*b*, 110*c* in a retaining wall 110 produced with the wall block system of this invention in a vertically aligned or vertically staggered orientation. More specifically, the rear wall portion of the arm sections 54 located at the bottom of a successively higher course of wall blocks is engaged against edge 88 of tabs 80 when the front faces of successive courses of wall blocks are to be positioned in a vertically aligned orientation or against edge 90 of tabs 80 when the front faces of successive courses of wall blocks are to be positioned in an offset or vertically staggered orientation.

Since the wall blocks 24 are commonly laterally staggered in stacked courses as seen at 110*a*, 110*b*, 110*c*, the length of the connection device 70, shown in FIG. 6, will be such as to fit within the superimposed portions of the grooves and slots in vertically juxtaposed blocks. More specifically, when the fingers 72 of the connection device 70 are driven into the arm sections 52 to engage the side walls 58, the connection device 70 must fit within the arm sections 52. The upwardly extending locating tabs 80 of the connection device 70 project then above surface 34 of a lower course of wall blocks 24 and are accommodated within the arm sections 54 of blocks 24 in an upper course. Since individual blocks in successive courses of the blocks are laterally staggered with respect to a successively lower course of wall blocks, the connection devices 70 must be carefully positioned within the arm sections 52 so as to align with the arm sections 54 on a successively higher course of wall blocks.

In the embodiment of FIGS. 8 and 9, each wall block 24 is only connected to one superimposed wall block by a connection device 70, with no direct connection between adjacent wall blocks in a course of wall blocks or other superimposed wall blocks in a higher course. Sections of wall blocks connected in a stair-step pattern may then be interfitted to rest on each other by gravity in the formation of a retaining wall. Such a construction is quite acceptable for many applications, particularly with retaining walls of relatively low height.

Figure 10:
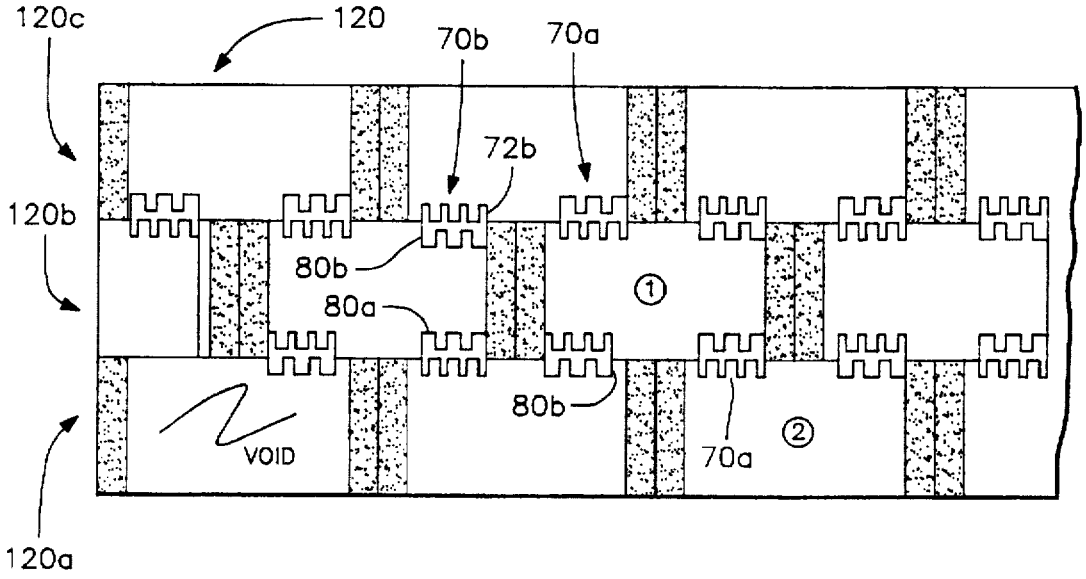
FIG. 10 is a view similar to FIG. 9, with inverted connection devices interconnecting laterally offset, superimposed wall blocks to further integrate the retaining wall.

For the construction of retaining walls of increased height, a retaining wall 120 as shown in FIG. 10 may be constructed. Retaining wall 120 may include a similar interconnection between superimposed blocks in courses 120*a*, 120*b* and 120*c*, for example, as shown in FIG. 9 using connector devices 70*a* in a stair-step fashion. However, in FIG. 10, additional connector devices 70*b* are used which are opposite in orientation to those of connector devices 70*a*. In this embodiment, a connector device 70*b* is inverted and the fingers 72*b* of the connector device are driven into the arm section 52 in the lower surface 36 of a wall block 24. Accordingly, when the wall block is set in a staggered, offset relationship with respect to the wall blocks of a successively lower course of wall blocks, tabs 80*a* of connector device 70*a* extend upwardly into arm section 54 in the lower surface 36 of a wall block and the tabs 8O*b* of a connector device 70*b* extend downwardly into the arm section 54 in an upper surface 34 of a successively lower wall block.

As shown in FIG. 10, each wall block above the lowermost course 120*a* and below the uppermost course 120*c* in the retaining wall 120, is secured to two different wall blocks in a successively lower course of wall blocks and to two different wall blocks in a successively higher course of wall blocks. The additional interconnections between wall blocks, over those shown in FIG. 9, provides additional strength to the retaining wall, facilitating an increased height.

Figure 11:
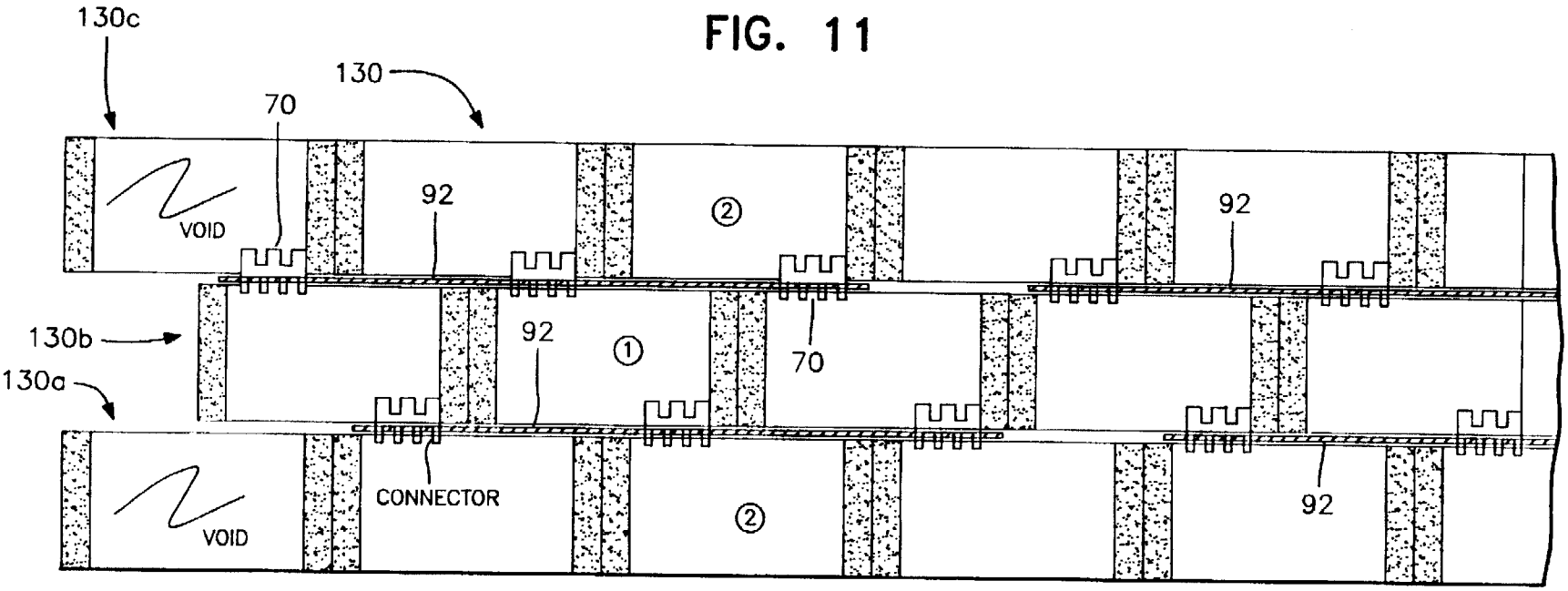
FIG. 11 is a view similar to FIG. 9 with sections of a grid-like sheet material spanning a plurality of wall blocks in each course of wall blocks to integrate the resultant retaining wall.
Figure 13:
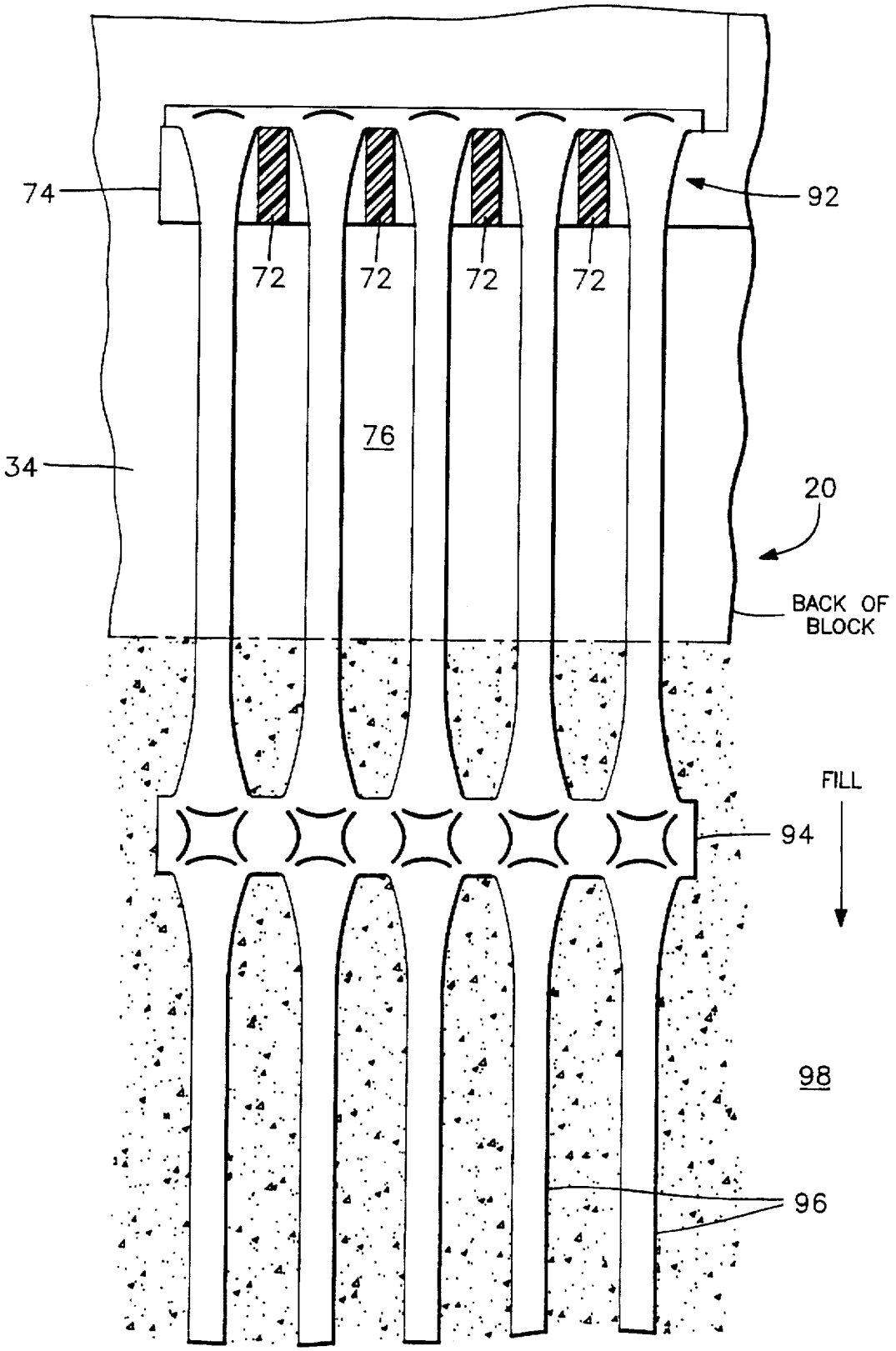
FIG. 13 is a plan view, with a section taken of the connection device, to illustrate the fingers of the connection device passing through the openings in end portions of a sheet of geogrid to secure the geogrid to a top surface of a wall block.

In the embodiment of FIGS. 11–13, retaining wall 130 is constructed using connection devices 70 in the manner illustrated in the retaining wall 110 shown in FIG. 9. However, as will be seen in FIG. 11, grid-like sheets of material 92 are placed across the upper surfaces 34 of a plurality, preferably at least three, wall blocks 24 and secured in place by the fingers of the grid connectors as described herein.

The grid-like sheet of material thus acts to strengthen the connection between adjacent wall blocks in a given course as well as successively higher courses of wall blocks, so that, e.g., the stair-step sections of the retaining wall 130 are interconnected via the connection of the grid material by the connector devices 70.

If the reinforcing sheet material is a uniaxially oriented geogrid as shown at 92 in FIGS. 12 and 13, the geogrid is placed on the upper surface 34 of a plurality of blocks 24, with a transverse bar 94 forwardly of the arm sections 52 and the strands 96 spanning the arm sections 52. The fingers 72 of a connection device 70 pass through the apertures 76 of the geogrid and the spine or crossbar 74 captures the end portions of the geogrid and fixedly secures the same to the modular wall block with the remainder of the grid-like sheet of material 92 extending rearwardly from the block 24 into the soil or other particulate material 98 as best seen in FIG. 13.

The area behind the rear faces 28 of the blocks 24 is progressively backfilled with soil or other aggregate 98 as the courses are laid to secure the extended lengths of sections of grid-like sheet of material 92 within the fill material 98. The grid-like sheet of material 92 functions to reinforce the fill 98 and thereby create a contiguous mass in a well known manner.

The tabs 80 and spine 74 of the connection device 70, and all portions of the grid-like sheet of material 92 passing over the upper surface 34 of the block 24, are above the level of the upper surface 34 of the block 24. By the arrangement of connection devices 70, shown in FIG. 11, the grid-like sheet of material 92 interconnects at least three adjacent blocks 24, for example, in a course of blocks. Superimposed courses of staggered blocks 24 with grid-like sheets of material 92, serves to tie together the courses of blocks of the thusly-formed retaining wall 130.

The section of grid-like sheet of material 92 illustrated in the drawings is representative of an extended length of grid-like sheet of material which is to be secured to a modular wall block 24 and typically measures four feet wide in the direction of the junction bars 94, and anywhere from four to twenty-five feet or more in length in the direction of the longitudinal axis of the strands 96.

As is usual and customary in the industry in the construction of a retaining wall, after the laying of several courses of wall blocks, the courses are shimmied to be level to accommodate the placement of sheets 92 of grid-like material between courses of blocks and any variances from acceptable tolerances in the construction of the wall blocks. The width of the arm section 54 is intended to be approximately ¼ of an inch wider than the width of the tab 80 to allow some play in the positioning of a successively higher course of modular wall blocks and to permit superimposed wall blocks, which are usually laterally staggered with respect to the blocks in a lower course, to be easily slid sideways during construction.

Figure 14:
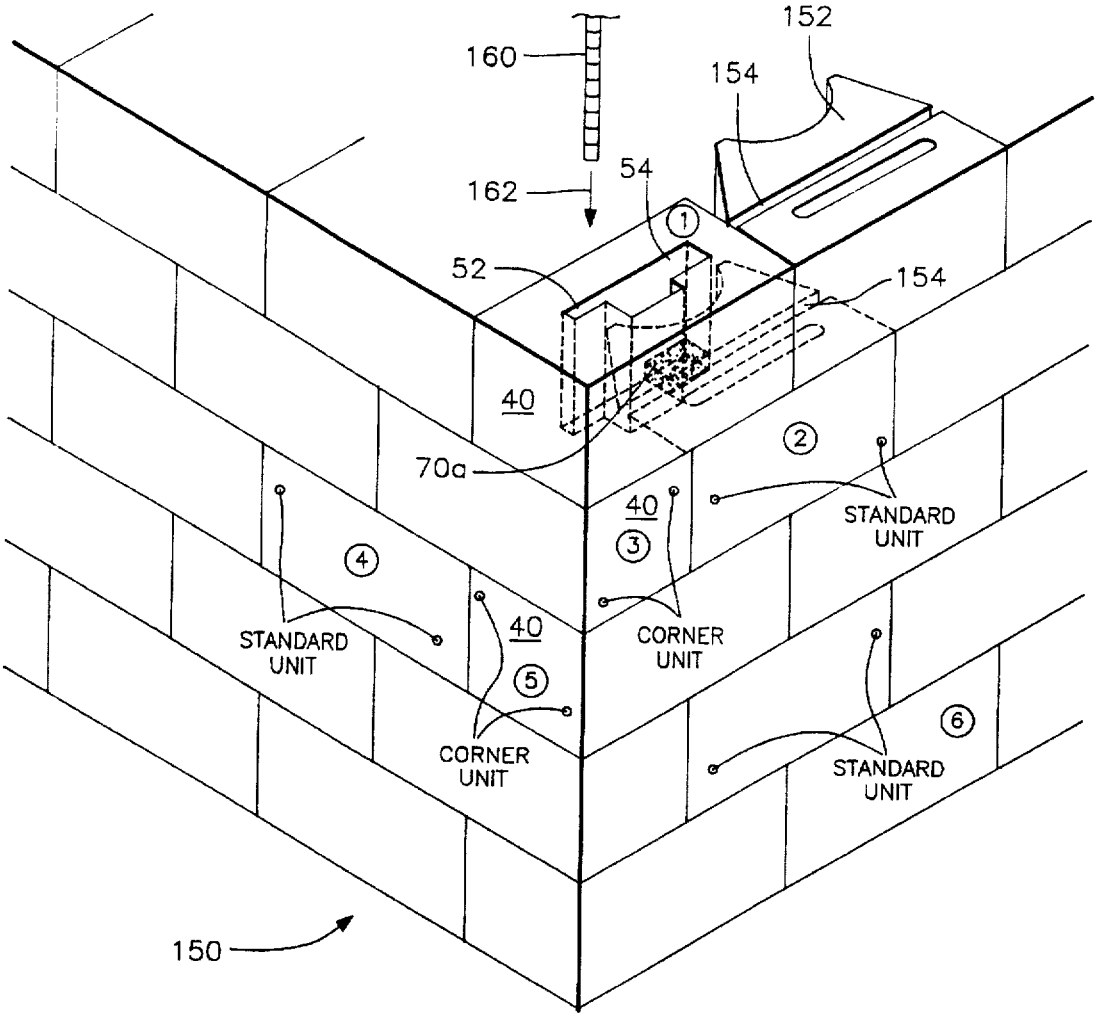
FIG. 14 is a perspective view of a portion of a hybrid retaining wall having perpendicularly extending sections formed primarily of basic wall blocks according to the '324 application referred to above, with the wall blocks of the present invention used as corner blocks.
Figure 15:
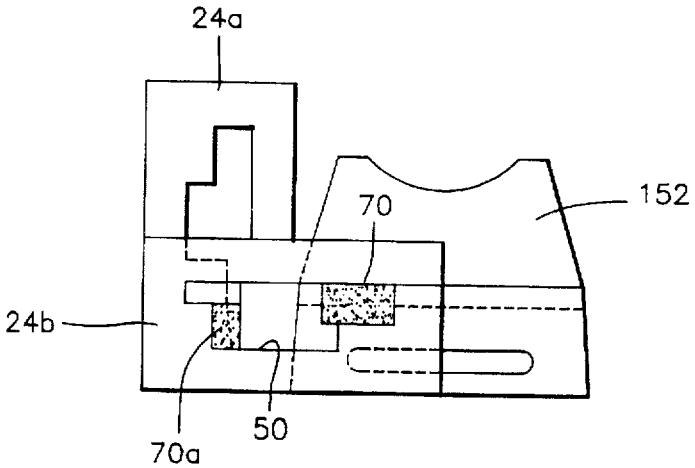
FIG. 15 is a fragmentary plan view of a portion of the retaining wall shown in FIG. 14, illustrating the interconnection of the wall blocks at the corner.

In FIGS. 14 and 15 a hybrid retaining wall is schematically shown at 150 including a multiplicity of wall blocks 24 as described with reference to FIGS. 1–5, used to form a right-angled corner portion of the retaining wall, in combination with basic wall blocks 152 of the type disclosed in the aforementioned '324 application.

The straight portions of the retaining wall 150 are formed by interconnecting wall blocks 152 with appropriately sized connector devices 70, with or without sections of geogrid or the like (not shown). Where the corner blocks 24 are used, the teeth of a shortened connector device **70*a* is secured in a groove 154 of a wall block 152 with the tabs projecting upwardly into the arm section 54 at the lower surface 34 of a superimposed block 24 to anchor the blocks adjacent to the corner of the retaining wall. It may be desirable to insert a bar as shown at 160 in the direction of arrow 162 through the superimposed portions of arm sections 52, 54 of successively lower blocks until the ground is engaged so as to interconnect the blocks 24 at the corner of wall 150**.

Alternatively, as shown in FIG. 15, a grid connector **70*a* fixed in an arm section 52 of a corner block 24*a* projects upwardly so that the tabs of the connector device fit within the stem portion 50 of superimposed block 24*b*. By the proper dimensioning of the wall blocks 24, connector devices 70*a* can be used to interlock successively superimposed corner blocks in retaining wall 150**.

Having described the invention, many modifications thereto will become apparent to those skilled in the art to which it pertains without deviation from the spirit of the invention as defined by the scope of the appended claims.

I claim:

1. A modular wall block comprising:

a front face, a rear face, an upper surface, a lower surface, and opposed sidewalls defining side faces extending between said upper and lower surfaces and said front and rear faces, a first opening defined in each of said upper and lower surfaces parallel to, and spaced rearwardly of, said front face for receiving portions of a connector device, and a second opening defined in each of said surfaces parallel to, and spaced rearwardly of, said front face, for receiving other portions of the connector device so as to position the front faces of a superimposed course of wall blocks with respect to each other in one of a vertically aligned and vertically set back orientation, said first and second openings being at least partially defined by opposite ends of a through-opening extending from said upper surface of said block to said lower surface, said first openings at each of said surfaces being of different front to rear widths from said second openings, said first and second openings extending in opposite directions from a central stem section.

2. A modular wall block as claimed in claim 1 to be used as a corner block in forming a retaining wall having sections extending at right angles to each other, wherein said front face and at least one side face extend at right angles to each other.

3. A modular wall block as claimed in claim 2, wherein said front face and said at least one side face each include similar aesthetic patterns formed therein.

4. A modular wall block system to be used for forming a retaining wall, said modular wall block system comprising:

a plurality of wall blocks each having a front face for forming a portion of an exterior surface of the retaining wall, a rear face, upper and lower surfaces, and opposed sidewalls defining side faces extending between said upper and lower surfaces and said front and rear faces, connector devices for interconnecting superimposed courses of said wall blocks with successively lower courses in the retaining wall, a first opening defined in each of said surfaces of each wall block parallel to, and spaced rearwardly of, said front face for receiving first portions of a connector device when the retaining wall is built, and a second opening defined in each of said surfaces of each wall block parallel to, and spaced rearwardly of, said front face for receiving other portions of said connector device when the retaining wall is built so as to position the front faces of superimposed courses of wall blocks with respect to each other in one of a vertically aligned and vertically set back orientation, said first and second openings in each wall block being at least partially defined by opposite ends of a through-opening extending from said upper surface of said block to said lower surface, said first opening at each of said surfaces being of different front to rear widths from said second opening.

5. A modular wall block system as claimed in claim 4 wherein, said through-opening is T-shaped and defines T-shaped apertures in each of said surfaces, each T-shaped aperture including a central stem section extending toward said front and rear faces of said block, and said first and second openings being defined by arm sections extending outwardly from a front end of said stem section parallel to said front face and toward respective sidewalls of said block.

6. A modular wall block system as claimed in claim 4 wherein at least some of said wall blocks are corner blocks to be used for forming a retaining wall having sections extending at right angles to each other, at least said corner blocks include a front face and at least one side face extending at right angles to each other, each of which define portions of the respective sections of a retaining wall face.

7. A modular wall block system as claimed in claim 6, wherein said front face and said at least one side face of said corner blocks include similar aesthetic patterns formed therein.

8. A modular wall block system as claimed in claim 4, wherein said first portions of said connector device includes a plurality of finger members and said other portions of said connector device include at least one tab extending away from said finger members, a central axis of said finger members being spaced from a central axis of said at least one tab.

9. A modular wall block system as claimed in claim 4, further comprising a sheet of reinforcing material having end portions to be secured to selected wall blocks with the remainder of the sheet of reinforcing material extending rearwardly into fill material behind the retaining wall to reinforce the retaining wall when the retaining wall is built.

10. A modular wall block system as claimed in claim 9, wherein said end portions of said sheet of reinforcing material defines a plurality of laterally spaced openings, said first portions of said connector device to be passed through said spaced openings of said sheet of reinforcing material to be frictionally received in said first opening in said upper surface of said selected wall blocks with additional portions of said connector device overlying portions of said sheet of reinforcing material and thereby securing said sheet of reinforcing material to said selected wall blocks.

11. A retaining wall comprising:

a plurality of courses of superimposed wall blocks, each wall block having a front face forming a portion of an exterior surface of the retaining wall, a rear face, upper and lower surfaces, and opposed sidewalls defining side faces extending between said upper and lower surfaces and said front and rear faces, connector devices interconnecting superimposed wall blocks to successively lower wall blocks, a first opening defined in each of said surfaces of each wall block parallel to, and spaced rearwardly of, said front face, first portions of a connector device frictionally received in said first opening in the upper surface of each wall block, a second opening defined in each of said surfaces of each wall block parallel to, and spaced rearwardly of said front face, other portions of said connector opening received in said second opening in the lower surface of each wall block so as to position the front faces of superimposed courses of wall blocks with respect to each other in one of a vertically aligned and vertically set back orientation, said first and second openings in each wall block being at least partially defined by opposite ends of a through-opening extending from said upper surface of said block to said lower surface, said first openings at each of said surfaces being of different front to rear widths from said second opening, and fill material located behind said rear face of said wall blocks for reinforcing said retaining wall.

12. A retaining wall as claimed in claim 11 having sections extending at right angles to each other, at least some of said wall blocks being corner blocks, at least said corner blocks including a front face and at least one side face extending at right angles to each other, each of which define portions of said respective sections of the retaining wall.

13. A retaining wall as claimed in claim 12, wherein said front face and said at least one side face of said corner blocks include similar aesthetic patterns formed therein.

14. A retaining wall as claimed in claim 11, wherein said through-opening is T-shaped and defines T-shaped apertures in each of said surfaces, each T-shaped aperture including a central stem section extending toward said front and rear faces of said block, and said first and second openings being defined by arm sections extending outwardly from a front end of said stem section parallel to said front face toward respective sidewalls of said block.

15. A retaining wall as claimed in claim 11, wherein said first portions of said connector device includes a plurality of finger members and said other portions of said connector device include at least one tab extending away from said finger members, a central axis of said finger members being spaced from a central axis of said at least one tab.

16. A retaining wall as claimed in claim 11, further comprising a sheet of reinforcing material having end portions secured to selected wall blocks with the remainder of the sheet of reinforcing material extending rearwardly into said fill material behind the retaining wall to reinforce the retaining wall.

17. A retaining wall as claimed in claim 16, wherein end portions of said sheet of reinforcing material defines a plurality of laterally spaced openings, first portions of said connector device passing through said spaced openings of said sheet of reinforcing material and frictionally received in said first opening in said upper surface of said selected wall blocks, additional portions of said connector device overlying portions of said sheet of reinforcing material and thereby securing said sheet of reinforcing material to said selected wall blocks.

18. A retaining wall as claimed in claim 16, wherein each sheet of reinforcing material is connected to a plurality of laterally juxtaposed wall blocks in a course of wall blocks.

19. A retaining wall as claimed in claim 11, further including additional connector devices, said first portions of said additional connection devices being received in said first opening in said lower surface of each wall block, and said other portions of said additional connection devices being received in said second opening in said upper surface of each wall block.

20. A modular wall block comprising:

a front face, a rear face, an upper surface, a lower surface, and opposed sidewalls defining side faces extending between said upper and lower surfaces and said front and rear faces, a first opening defined in each of said upper and lower surfaces parallel to, and spaced rearwardly of, said front face for receiving portions of a connector device, and a second opening defined in each of said surfaces parallel to, and spaced rearwardly of, said front face, for receiving other portions of the connector device so as to position the front faces of a superimposed course of wall blocks with respect to each other in one of a vertically aligned and vertically set back orientation, said first and second openings being at least partially defined by opposite ends of a through-opening extending from said upper surface of said block to said lower surface, said first openings at each of said surfaces being of different front to rear widths from said second openings, said through-opening being T-shaped and defining T-shaped apertures in each of said surfaces, each T-shaped aperture including a central stem section extending toward said front and rear faces of said block and said first and second openings being defined by arm sections extending outwardly from a rear end of said stem section parallel to said front face and toward respective sidewalls of said block.

* * * * *